United States Patent [19]

Brovold

[11] Patent Number: 4,503,888

[45] Date of Patent: Mar. 12, 1985

[54] SERVOVALVE SPOOL CONTROL FOR DIGITAL ROTARY SERVOVALVE

[75] Inventor: Thomas E. Brovold, Eden Prairie, Minn.

[73] Assignee: MTS Systems Corporation, Eden Prairie, Minn.

[21] Appl. No.: 539,052

[22] Filed: Oct. 4, 1983

[51] Int. Cl.[3] ..... F17D 3/01; F15B 21/02

[52] U.S. Cl. ..... 137/625.65; 91/37; 251/133; 74/89.15

[58] Field of Search ..... 91/37, 39, 459, 466, 91/467, 380; 137/625.65; 251/133, 80, 267, 268, 272, 266; 74/89.15, 424.8 R, 424.8 VA

[56] References Cited

U.S. PATENT DOCUMENTS

| | | | |
|---|---|---|---|
| 544,752 | 8/1895 | Strater | 251/268 |
| 1,024,884 | 4/1912 | Fitts et al. | 251/266 |
| 3,381,712 | 5/1968 | Wittren et al. | 91/380 |
| 3,530,764 | 9/1970 | Tomita | 91/6.5 |
| 3,695,295 | 10/1972 | Olsen et al. | 137/625.69 |
| 3,752,038 | 8/1973 | Inaba et al. | 91/39 |
| 3,760,687 | 9/1973 | Inaba et al. | 91/39 |
| 3,899,956 | 8/1975 | Olsen | 91/368 |
| 4,031,811 | 6/1977 | Inaba et al. | 91/39 |
| 4,235,156 | 11/1980 | Olson | 91/363 R |

OTHER PUBLICATIONS

Publication, *The Electro-Hydraulic Stepping Motor, A Digital Hydraulic Actuator,* by Albert J. Sperbeck et al, Microprocessors in Fluid Power Seminar, Nov. 19, 1980.

*Primary Examiner*—Robert E. Garrett
*Assistant Examiner*—H. Edward Li
*Attorney, Agent, or Firm*—Kinney & Lange

[57] ABSTRACT

A rotary to linear control for actuating an axially movable spool of a digital rotary input servovalve has a threaded drive between a rotating nut and a threaded shank directly connected to the spool. The threads are hydrostatically preloaded to eliminate thread backlash and provide improved valve-actuator stability. The rotary drive is a digital stepper motor capable of moving at incremental movements about its rotational axis which rotates the nut. The threads provide a preload and a cushioning effect which essentially provides an accurate reference position for the axially movable spool each time the threads are actuated.

9 Claims, 3 Drawing Figures

SERVOVALVE SPOOL CONTROL FOR DIGITAL ROTARY SERVOVALVE

BACKGROUND OF THE INVENTION

1. Field of the Invention

The present invention relates to digital rotary servovalves and more particularly to a rotary to linear converter comprising a pressure preloaded spool drive thread for the servovalve spool.

2. Description of the Prior Art

Rotary to linear converters for rotary servovalves have been well known in the art. Usually the rotary servovalve has a rotary input that is connected to a stepper motor which rotates in controllable incremental steps, and moves a spool linearly to cover and uncover ports to control hydraulic flow under pressure. The spool must move under control in both directions with minimum backlash, for precise control of a closed loop system having an actuator that feeds back signals to the stepper motor. The stepper motor then is controlled by some independent program source.

The use of helical threads for converting rotary to linear movement in rotary servovalves is not new in and of itself. For example, the devices shown in U.S. Pat. No. 3,530,764, issued Sept. 29, 1970 to Kabushiki et al.; U.S. Pat. No. 3,760,687, issued Sept. 25, 1973 to Inaba et al.; U.S. Pat. No. 3,752,038, issued Aug. 14, 1973 to Inaba et al. and U.S. Pat. No. 4,031,811, issued June 28, 1977 to Inaba et al., show thread-type rotary to linear translators, but not incorporating the features of the present invention.

U.S. Pat. No. 3,899,956, issued Aug. 19, 1975 to Olsen et al. shows a system using a rotary servovalve of the general type contemplated herein under control of a stepper motor. However, in the Olsen et al. patent a spring loaded nut is used to provide take-up, which can give some problems in stability and accurate operation.

U.S. Pat. No. 3,695,295, issued Oct. 3, 1972 to Olsen et al. also relates to servovalves operated as a digital servovalve with rotary to linear translators operated by a stepper motor.

U.S. Pat. No. 4,235,156, issued Nov. 25, 1980 to Olsen et al. includes a servovalve operated by a digital controller.

SUMMARY OF THE INVENTION

The present invention relates to a rotary drive-linearly operated servovalve including a rotary to linear converter thread drive between the input rotational drive (stepper motor) and the spool for the servovalve which must move linearly. The stepper motor positions the spool of the servovalve through the rotary to linear translator or converter comprising the nut arrangement. The translator comprises a precisely tapped nut coupled to the stepper motor shaft and preloaded under pressure against precision threads ground into one end portion of the servovalve spool.

The nut is formed so that the hydraulic system return pressure acts on the nut relative to the spool to always return the same side surfaces of the nut and spool threads into contact. The nut and stepper motor are made to drive the spool selectively in both axial directions and upon reverse movement of the nut the thread clearance provides a cushion of hydraulic fluid that has to be squeezed out of the nut through the helical clearance opening of the threads. This provides stiffness in movement in reverse direction, either from input or feedback operation and accurate control in both directions of movement of the spool is achieved.

The nut and spool threads are made so that they will always return to the same contact position because of the pressures acting in the system relative to the nut and spool.

The nut is preloaded against a thrust bearing by an annular flange. It is always maintained coaxially with the spool bore and the spool axis by hydrostatic pressures acting circumferentially around the nut.

DETAILED DESCRIPTION OF THE PREFERRED EMBODIMENT

A typical rotary servovalve arrangement is illustrated generally at 10, and comprises a servovalve assembly 11 which, as will be explained, includes a linear movable spool valve in a normal manner, and the spool valve moves linearly to control hydraulic fluid from a pressure source through outlet control ports shown at 12 and 13. These will lead to a hydraulic actuator in a normal manner, which will either provide a mechanical feedback signal that tends to return the spool to null position as is disclosed in the prior art or generate feedback signals to a stepper motor 14 that is controlled in a suitable manner under an electrical signal to rotate its output shaft at discrete steps depending on the control signal that is provided from a command. The stepper motor—rotary servovalve arrangement is well known, and in all such devices it is necessary to provide a rotary to digital conversion and at least desirable to provide feedback. Generally, this type of drive is of the type shown in U.S. Pat. Nos. 3,695,295 and 4,234,156 described in the prior art section. Problems may arise because of backlash in the drive arrangement in the rotary to linear conversion assembly. With the present device, the problems of backlash are substantially reduced.

Figure 2:
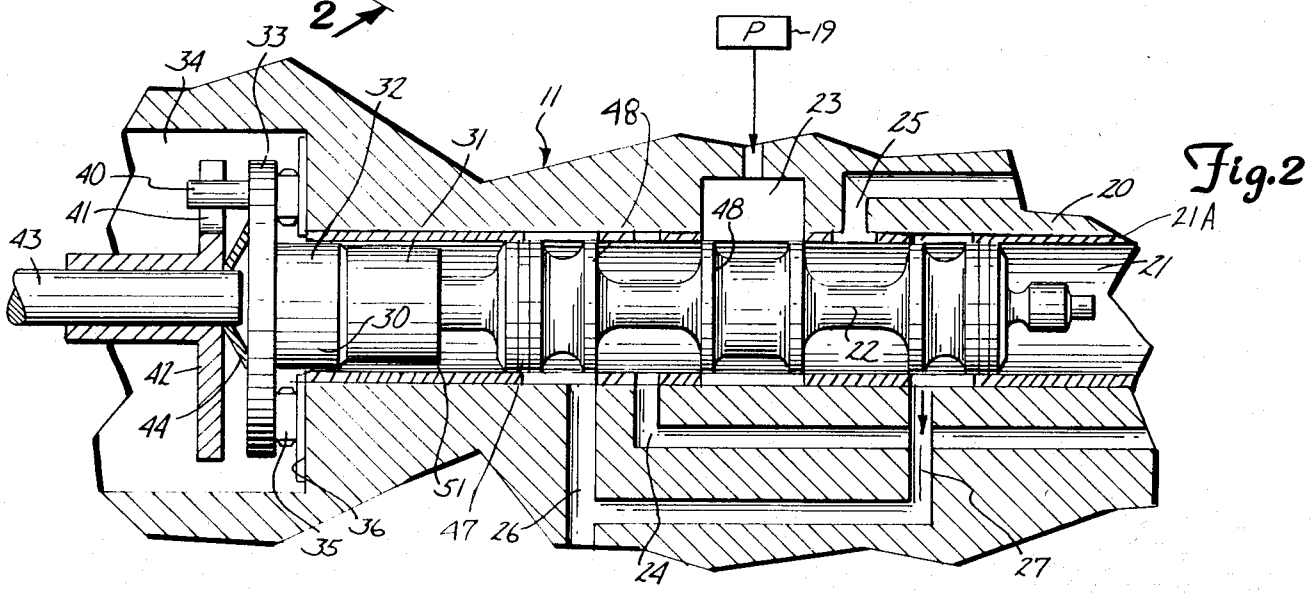
FIG. 2 is a fragmentary sectional view taken along line 2—2 in FIG. 1.

Referring to FIG. 2 in particular, the servovalve body or housing 20 has an internal bore 21 formed inside a sleeve 21A. The bore 21 has a servovalve spool 22 slidably and rotationally mounted therein. The spool 22, as shown, has a plurality of different "lands" that control flow from a pressure source 19 through a pressure port 23 in the valve body 20 opening into bore 21, to a first control port 24, or to a second control port 25. The first and second control ports open into bore 21 at locations spaced axially from the pressure port.

The control ports are used to direct fluid under pressure to, and return flow from a controlled actuator or motor (not shown). Normally the actuators or motors are double acting and the control ports 24 and 25 alternately will carry pressure or return flow depending on the direction of movement of the spool 22. The feedback signals may be provided conventionally.

Passageways 26 and 27 carry return fluid flow to the supply. Return flow is generally at a positive pressure in the range of 15 psi static pressure up to 50 psi during operation, and is generally controlled at such pressure for purposes of stability and control in servovalves. "Drain" pressure of course is substantially atmospheric, or zero gage pressure, and as will be apparent, the differential between the return pressure and what is known as drain pressure or atmospheric pressure provides the necessary differentials for satisfactory operation of the device of the present invention.

The bore 21 supports and receives a spool drive nut 30 at one end thereof, as shown, and as will be explained the spool drive nut 30 has an internal, helical thread that drives the spool center stem.

The spool nut 30 has a reduced outer diameter portion 31 at its inner end and a guide portion 32 of larger diameter than portion 31 to form an annular shoulder. The portion 32 fits closely in the interior surface of the bore 21. The nut includes a perpendicular annular flange 33 that is on the outside of the bore 21, and is positioned within a cavity 34 formed in the valve body 20. A thrust bearing 35 is positioned between one surface of the flange 33, and the surface 36 of the cavity 34. The surface 36 is perpendicular to the axis of the bore 21. This surface 36 can be precisely machined, and the thrust bearing and flange 33 hold the axis of the nut 30 precisely parallel with the axis of bore 21 and thus with the spool axis.

The flange 33 has a drive peg 40 fixed thereto and extending outwardly therefrom on a side opposite from the thrust bearing 35. The drive peg 40 is received in a slot 41 of a drive coupling 42 that in turn is driven from the output shaft 43 of the digital stepper motor 14.

A belleville spring washer 44 is positioned between the drive flange 42 and the flange 33, to provide a spring load of the flange 33 against the thrust bearing 35 and thus against the surface 36 so that the nut is properly located in axial direction mechanically by the reaction between the stepper motor coupling and the flange 33 under the spring load of the spring washer 44.

Figure 3:
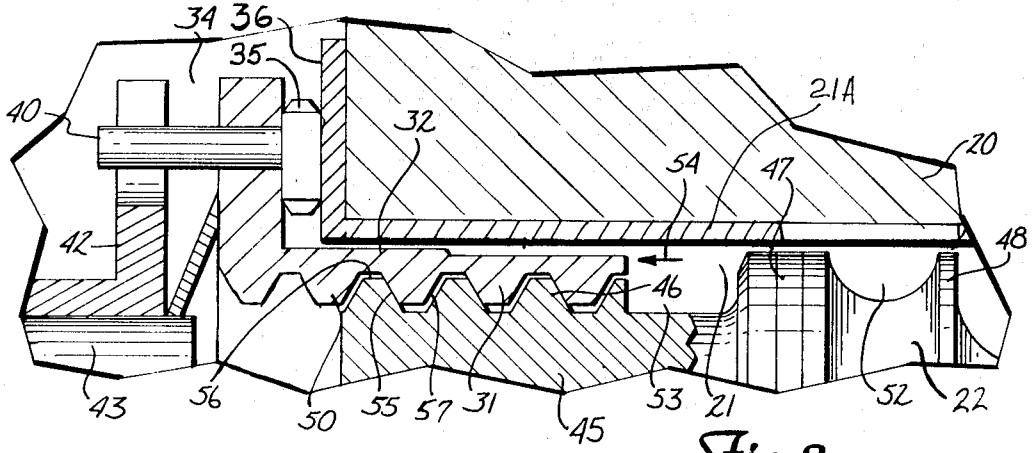
FIG. 3 is an enlarged sectional view of the thread configuration used for the rotary to linear drive of the present invention.

Referring to FIG. 3, it can be seen that the spool 22 has a shank portion 45 which has a precise stub thread indicated generally at 46 formed on the outer surface. This shank 45 is to the left of a spool guide land 47, and a spool flow land 48 associated with the return port 26. The nut 30 includes an internal thread indicated at 50 that mates with thread 46. The threads 46 and 50 have mating surfaces along the sides thereof as shown at 55 in FIG. 3.

As shown in FIG. 3, the larger diameter portion 32 of the nut 30 fits closely within the bore 21 of the valve housing 20, and the reduced diameter section 31 forms an annular space 51 within the bore 21.

Return passageway 26 is positioned between the support land 47 and the land 48 and forms a return pressure chamber indicated at 52. The support land 47 does not substantially block pressure, but does limit flow. In other words, there is a clearance between the outside surface of the support 47 of the spool and the interior of the bore 21, so that in the bore portion shown at 53 return pressure, that is approximately 15 psi at rest, up to 50 psi, is present.

The cavity 34 is at drain pressure or atmospheric pressure. Thus there is a pressure gradient across the section 32 of the nut 30, and this will cause a force in the direction as indicated by the arrow 54 to tend urge the nut in that direction relative to the spool. The pressure reacts against the spool land 48 to tend to separate the nut 30 and the spool section 45 with threads 46, and thereby bring the surfaces of the threads 50 and 46 into contact along the edges or surfaces shown at 55.

Whenever the spool is at rest, and the nut 30 is not being rotated by the digital stepper motor, the nut and spool will always assume a preset position with the surfaces contacting as shown at 55.

The threads on the interior of the spool nut 30 and on the exterior of the shank 45 are precisely made, and the exterior apex surface or edge surface 56 of the threads 46 form a clearance with the interior root surface of the internal threads on the spool nut 30, and also there is a clearance space shown at 57 between the adjacent surfaces of the interior thread 50 and the exterior thread 46 which traps oil, when the spool and nut have assumed the position shown in FIG. 3.

Figure 1:
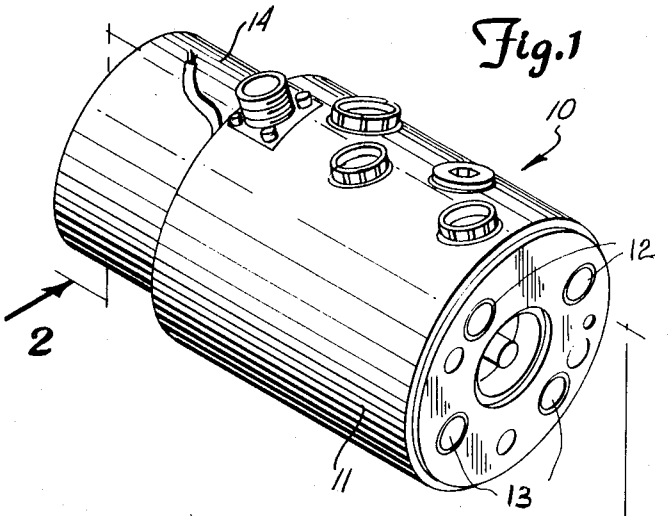
FIG. 1 is a perspective view of a typical rotary servovalve having a rotary to linear actuator made according to the present invention.

Thus, the spool 22 and the spool nut 30 will always be in contact along the surfaces 55 when a signal comes to the stepper motor 14 to rotate the shaft 43, drive the coupling 42, and to, in turn, rotate the drive peg 40, and the nut 30 through the flange 42. Assuming that the nut 30 is being driven in the direction that will tend to move the spool linearly to the left in FIG. 1, or in the direction of the arrow 54, the thread surfaces are in contact as shown at 55 and an immediately positive movement linearly will occur that will move the spool 22 axially a precise amount causing the lands to open control port 25 to pressure, and connecting the other control port to return.

However, if the nut is to be rotated in the second direction, that is the nut 30 is driving in direction opposite from that shown by the arrow 54, the clearance space shown at 57 will be filled with hydraulic oil and this will provide a ribbon of oil that has to be extruded out of the nut 30 before there is any relative axial movement between the nut and the spool. The clearances shown at 56 at the apex of the external threads is also precisely controlled as explained, so that the ribbon of oil provides a stiff connection between the nut and the spool under rapid movements because the oil will not escape quickly. There is very little tendency for backlash or slop to occur during the initial movements in either direction of movement.

Usually the movements of the stepper motor are rapid, and not very great, and the amount of oil being extruded will be quite small because the clearances will be maintained in the range of 0.0004 inches. The small clearances act as an orifice that restricts bleed under rapid loading.

The servovalve of course receives a feedback signal from the actuator being controlled, and as soon as the nut 30 stops rotating, the pressure from the return port in chamber 53 again will act as shown by the arrow 54 to bring the surfaces into contact along the edges shown at 55 between the thread 50 and the thread 56.

The oil in the space around the nut also acts as a hydrostatic bearing for the nut under high rotational velocities. The annular cushion of oil around the nut keeps the nut centered in the bore. The surface 36 and the flange 30, through the thrust bearing 35, also aid in keeping the nut centered and coaxial with the spool and bore.

The mating thread length of the threads 46 and 50 is predetermined so that the ribbon of oil in the helical chamber 57 is sufficient to provide adequate stiffness during movement that would tend to squeeze the oil out of the threads. Further, the space provides for a controlled leakage of oil back into the chamber 34 through the threads, but again the spacing is small so that there is very little leakage, but yet a ribbon of oil has to be extruded out one end or the other of the nut before there will be a shift in the relative positions of the nut and the spool when the nut is moved in direction tending to take up the space 57.

It should be noted that as the ribbon of oil is squeezed out, it will go out into the drain cavity 34, and also some will tend to go out into the cavity 53. The thread length is made so that the oil from the middle of the nut has to bleed out slowly through the effective orifice to provide a stiff coupling through the threads as the oil film is squeezed out.

The return of the drive to a reference position each time the motor is stopped simplifies feedback, which may be made by inputing a rotational signal onto the spool to reverse the axial movement of the spool back to its rest position. In other words, the nut 30 is driven in one rotational direction to move the spool axially and the feedback from the actuator will in a mechanical system rotate the spool relative to the nut to cause opposite axial movement of the spool to a balanced position.

Although the present invention has been described with reference to preferred embodiments, workers skilled in the art will recognize that changes may be made in form and detail without departing from the spirit and scope of the invention.

What is claimed is:

1. In a rotary to axial converter for a servovalve assembly, said servovalve assembly including a housing, said housing having a bore with pressure supply, control and return ports, and a spool slidably mounted in the bore in said housing and having lands acting for valving the ports in the bore for selectively controlling flow with respect to the ports as the spool moves along the bore, said spool having a shank adjacent one end, the improvement comprising an external thread on said shank, and a nut having an internal thread mounted on said shank thread for threadable movement and having a reference position relative to the housing, means to rotationally drive said nut to cause a linear movement of said spool relative to the bore as the threads cooperate for relative movement, said nut having an external surface portion slidably mounted in the bore of the servovalve housing, and a portion forming a shoulder facing the spool and open to a return port positioned between the shoulder and one land on the spool to build up return pressure on a side of said nut toward said spool and between the shoulder and the one land, said mating threads between the interior of said nut and the shank thereby being forced so that preselected surfaces are in contact under return pressure exerted between the shoulder and the one land of the spool, the clearance between the exterior thread on the shank and the interior thread in the nut being maintained at a desired amount.

2. The combination as specified in claim 1 wherein said nut has a flange perpendicular to the central axis of the internal thread, said housing having a surface perpendicular to the bore, said flange and said perpendicular surface being adjacent, and thrust bearing means between said flange and said perpendicular surface to form the reference position with the flange forced against the perpendicular surface through said thrust bearing.

3. The apparatus of claim 2 wherein said rotational drive for said nut comprises a stepper motor having a rotationally driven shaft, a drive coupling between said stepper motor and said flange, said stepper motor being movable in both directions of rotation, and bias means urging said flange toward said perpendicular surface.

4. The apparatus as specified in claim 1 wherein the shoulder formed on the nut is on the interior of the bore of the valve housing.

5. The apparatus as specified in claim 1 wherein said thread on said spool is a ground thread, and each of the thread portions has an outer apex surface that is generally annular and provides a controlled clearance to the mating interior surfaces at the root of the threads on the interior of the nut.

6. The combination of claim 1 wherein said return pressure acting between said nut and said spool is maintained in the range of 15 psi to 50 psi.

7. The apparatus of claim 2 wherein the flange on the exterior of said nut is maintained at substantially atmospheric pressure.

8. In a rotary to axial converter for a servovalve assembly, said servovalve assembly including a housing, said housing having a bore with pressure supply, control and return ports, and an elongated spool mounted for axial slidable movement in said housing and having land fitting within the bore of such housing for selectively controlling flow with respect to the ports as the spool moves axially relative to the ports, the improvement comprising a rotary drive member having a portion mounted in the bore and adapted to be rotated for operation, means for establishing a reference location of the rotary drive member along the axis of the bore, said rotary drive member and said spool having cooperating helical threads for relative rotational movement of the drive member and spool causes a linear movement of said spool, a first land on said spool being open to return flow pressure adjacent the helical threads on the spool, shoulder means on the portion of the rotary drive member mounted in the bore forming a shoulder surface facing the first land of the spool within the bore and open to a return pressure port between the first land and the shoulder surface for forcing the cooperating threads to position so that preselected surfaces of the threads are in contact under return pressure, the clearance between the exterior thread on the shank and the interior thread in the nut being maintained at a desired amount.

9. A rotary to axial converter for a servovalve assembly for use in a housing having a bore with an axis and pressure supply, control and return ports spaced along the bore axis, and a spool of size to fit in the bore of such housing having an elongated shank of smaller size than the bore and a plurality of lands closely fitting in the bore and acting to valve the ports, respectively, for controlling flow through the ports, said spool having a shank section adjacent one end with helical thread formed thereon, a nut mounted for rotation adjacent one end of the bore and threadably mounted on the shank thread for threadable movement, said nut having flange means on the exterior of the housing in which it is mounted cooperating with a surface of such housing to establish a reference spool position, means for rotationally driving said nut to cause a linear movement of said spool as the threads cooperate for relative movement, said nut having an external surface portion within a bore in which the spool is mounted forming a shoulder facing the spool and open to return pressure to cause a build up of return pressure on a side of said nut toward said spool, said mating threads between the nut and the shank thereby being subjected to axial force so that preselected surfaces of the threads are in contact under return pressure between the shoulder and the spool, the clearance between the thread on the shank and the thread in the nut being maintained at a desired amount to form a helical passageway filled with oil along the length of mating threads which cushions movement of the nut relative to the spool tending to separate the preselected surfaces against the force generated by the return pressure acting on the shoulder.

* * * * *